US006800191B2

(12) United States Patent
Barnett et al.

(10) Patent No.: US 6,800,191 B2
(45) Date of Patent: Oct. 5, 2004

(54) ELECTROLYTIC CELL FOR PRODUCING ALUMINUM EMPLOYING PLANAR ANODES

(75) Inventors: Robert J. Barnett, Goldendale, WA (US); Michael B. Mezner, Sandy, OR (US); Donald R Bradford, Underwood, WA (US)

(73) Assignee: Northwest Aluminum Technologies, Seattle, WA (US)

( * ) Notice: Subject to any disclaimer, the term of this patent is extended or adjusted under 35 U.S.C. 154(b) by 159 days.

(21) Appl. No.: 10/098,141

(22) Filed: Mar. 15, 2002

(65) Prior Publication Data

US 2003/0173227 A1 Sep. 18, 2003

(51) Int. Cl.[7] ..... C25C 3/08

(52) U.S. Cl. ..... 205/380; 205/381; 205/376; 205/372

(58) Field of Search ..... 205/380, 381, 205/372, 376

(56) References Cited

U.S. PATENT DOCUMENTS

| | | | | |
|---|---|---|---|---|
| 4,405,433 A | * | 9/1983 | Payne | 204/225 |
| 4,457,813 A | | 7/1984 | Rogers et al. | 204/74 |
| 4,568,439 A | | 2/1986 | Sobieniak | 204/242 |
| 4,670,113 A | | 6/1987 | Lewis | 204/80 |
| 4,938,853 A | | 7/1990 | Retallick et al. | 204/86 |
| 5,015,343 A | * | 5/1991 | LaCamera et al. | 205/354 |
| 5,284,562 A | * | 2/1994 | Beck et al. | 204/245 |
| 5,378,325 A | * | 1/1995 | Dastolfo, Jr. et al. | 205/394 |
| 5,421,977 A | | 6/1995 | Getsey et al. | 204/263 |
| 5,725,744 A | * | 3/1998 | de Nora et al. | 204/244 |
| 5,908,715 A | | 6/1999 | Liu et al. | 429/217 |
| 6,027,620 A | | 2/2000 | Jackson et al. | 204/253 |
| 6,258,247 B1 | * | 7/2001 | Brown et al. | 205/394 |
| 6,558,525 B1 | * | 5/2003 | Bradford et al. | 205/380 |

* cited by examiner

*Primary Examiner*—Roy King
*Assistant Examiner*—Harry D. Wilkins, III
(74) *Attorney, Agent, or Firm*—Andrew Alexander

(57) ABSTRACT

A method of producing aluminum in an electrolytic cell containing alumina dissolved in an electrolyte, the method comprising providing a molten salt electrolyte having alumina dissolved therein in an electrolytic cell. A plurality of anodes and cathodes having planar surfaces are disposed in a generally vertical orientation in the electrolyte, the anodes and cathodes arranged in alternating or interleaving relationship to provide anode planar surfaces disposed opposite cathode planar surfaces, the anode comprised of carbon. Electric current is passed through anodes and through the electrolyte to the cathodes depositing aluminum at the cathodes and forming carbon containing gas at the anodes.

26 Claims, 5 Drawing Sheets

ELECTROLYTIC CELL FOR PRODUCING ALUMINUM EMPLOYING PLANAR ANODES

The government has rights in this invention pursuant to Contract No. DE-FC07-98ID13662 awarded by the Department of Energy.

BACKGROUND OF THE INVENTION

This invention relates to aluminum and more particularly it relates to an anode for use in the electrolytic production of aluminum from alumina dissolved in a molten salt electrolyte.

The use of low temperature electrolytic cells for producing aluminum from alumina has great appeal because the cells are less corrosive to materials comprising the cell. Inert anodes have exclusively been suggested for use in the low temperature cells. However, the use of inert anodes has the problem that the inert anodes require a decomposition voltage for alumina of about 2.3 to 2.6 volts. This adds greatly to the cost of electricity required to produce aluminum from alumina. Thus, it would be advantageous to produce aluminum in a low temperature, electrolytic cell having a lower decomposition voltage.

Different shaped anodes have been suggested in the various electrolytic processes. For example, U.S. Pat. No. 4,457,813 discloses electrolytic reactions carried out simultaneously at the anode and cathode of a diaphragmless electrolytic cell. This cell contained a three dimensional porous platinum-plated graphite anode (5×1×0.5 cm.) embedded centrally in one wall of a polypropylene cell body (61×15×2.5 cm.) In this process, separate useful reactions are conducted at an anode and cathode, respectively, by electrolysis of an anolyte at an anode and a catholyte at the cathode wherein the anolyte and catholyte are of different composition and are prevented from contacting the cathode and anode, respectively, during electrolysis without the use of selective permeable membranes or permeable partitions.

U.S. Pat. No. 4,568,439 discloses an electrolytic cell which has a spacing means positioned between the anode and cathode faces. The present spacing means comprises a plurality of longitudinally elongated, electrically non-conductive spacers fabricated of a chemically resistant material being inert to the conditions existing within an operating electrolytic cell. The present spacers are positioned on the face portion of a foraminous anode. The spacers are secured on the anode face by extension of a portion of the spacer through an opening in the anode and are secured at the back portion of the anode.

U.S. Pat. No. 4,670,113 discloses a process for the gasification or combined gasification and liquefaction of carbon or carbonaceous materials by utilizing electrochemically generated atomic hydrogen to activate the chemical reaction between the ions of dissociated water and the carbon or carbonaceous material in an electrolysis cell, thereby producing gaseous or combined gaseous and liquid products in amounts exceeding the Faraday equivalents of such products for the amount of electrical energy consumed.

U.S. Pat. No. 4,938,853 discloses non-adherent copper metal particles ("fines") formed in a plating bath during the course of autocatalytic electroless copper deposition onto activated substrate surfaces are oxidized and redissolved in the bath by brief application of current between an anode element and a cathode element immersed in the bath, the anode element being comprised of an anode surface substantially parallel and proximate to the bottom surface of the vessel containing the bath.

U.S. Pat. No. 5,908,715 discloses a composite particulate material for use in anodes of lithium-ion batteries. The particles of the material include a graphite core that has been provided with a surface layer including a non-graphitizable carbonaceous material. The graphite core has an interplanar spacing of at least about 0.346 nm. The method of producing the composite is also disclosed.

From the above, it will be seen that there is a need for a low temperature electrolytic cell capable of producing aluminum at a low decomposition voltage to reduce the cost of electricity required for producing aluminum in such cell.

SUMMARY OF THE INVENTION

It is an object of the present invention to provide an improved method for producing aluminum from alumina in an electrolytic cell.

It is an object of the invention to provide an improved method for producing aluminum in a low temperature electrolytic cell.

It is still another object of the invention to provide an improved method for supplying alumina-enriched electrolyte to the active surface of an improved anode in a low temperature electrolytic cell for producing aluminum.

And, it is another object of the present invention to provide a method of operating a low temperature electrolytic cell employing planar carbon anodes for producing aluminum from alumina.

These and other objects will become apparent from the specification, claims and drawings appended hereto.

In accordance with these objects, there is provided a method of producing aluminum in an electrolytic cell containing alumina dissolved in an electrolyte, the method comprising providing a molten salt electrolyte at a temperature of less than 900° C. having alumina dissolved therein in an electrolytic cell. A plurality of anodes and cathodes having planar surfaces are disposed in a generally vertical orientation in the electrolyte, the anodes and cathodes arranged in alternating or interleaving relationship to provide anode planar surfaces disposed opposite cathode planar surfaces, the anode comprised of carbon. Electric current is passed through anodes and through the electrolyte to the cathodes depositing aluminum at the cathodes and forming carbon containing gas at the anodes.

DETAILED DESCRIPTION OF PREFERRED EMBODIMENTS

The subject invention includes an electrolytic cell for the production of aluminum from alumina dissolved in a molten salt electrolyte. Preferably, the molten electrolyte is maintained at a temperature of less than 900° C. However, electrolytes such as cryolite may be used at higher temperatures, e.g., 925° to 975° C. Further, preferably, the alumina is added to the cell on a continuous basis to ensure a controlled supply of alumina during electrolysis. The electrolytic cell of the invention employs anodes and cathodes. In the process of the invention, electric current is passed from the anode through the molten electrolyte to cathode reducing alumina to aluminum and depositing the aluminum at the cathode. While the cathodes are preferably comprised of titanium diboride, it will be understood that the cathodes can be comprised of any suitable material that is substantially inert to the molten aluminum at operating temperatures. Such materials can include zirconium boride, molybdenum, titanium carbide, zirconium carbide and tungsten alloys.

Figure 1:
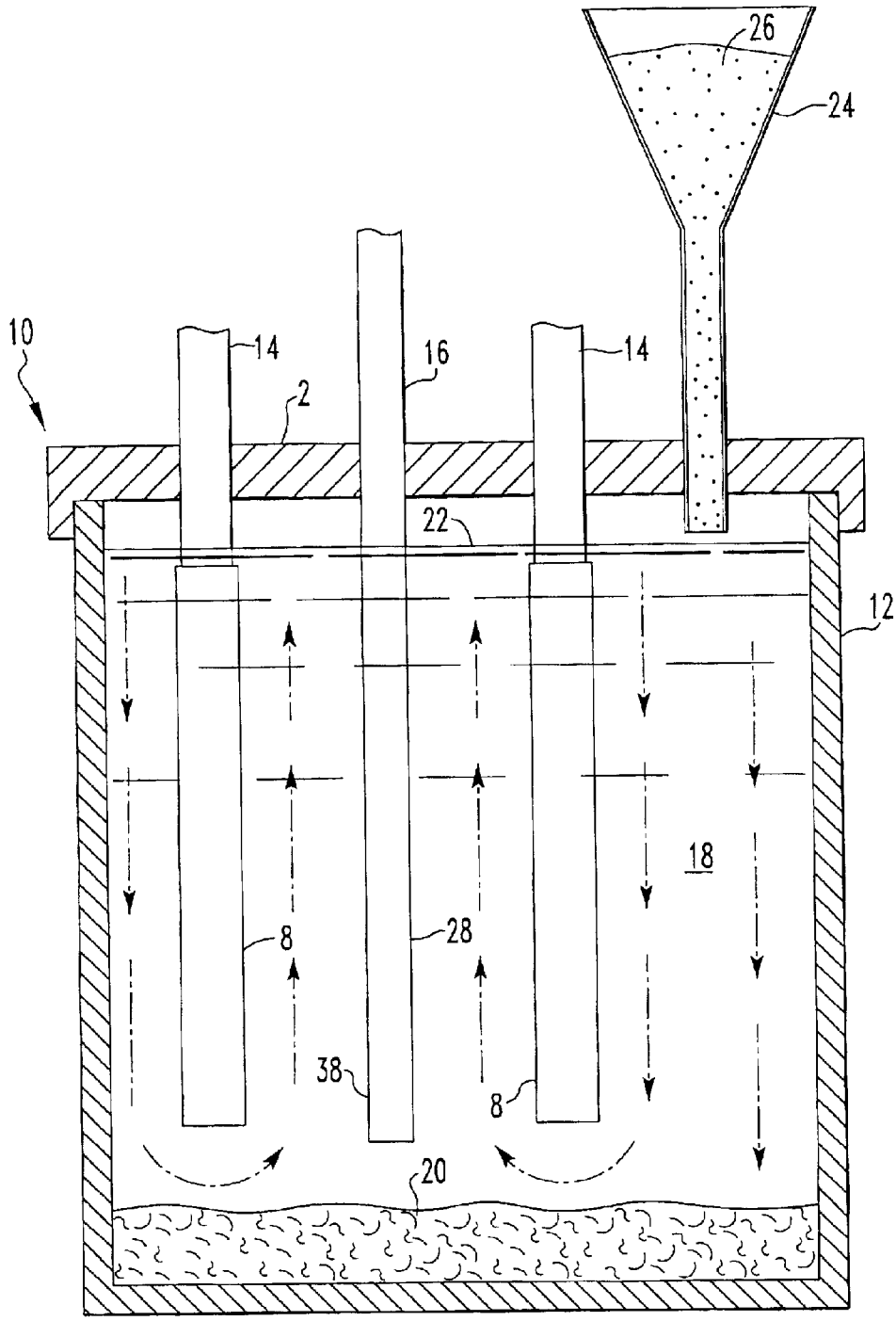
FIG. 1 is a cross-sectional view of an electrolytic cell used in testing elements of the invention.

Referring now to FIG. 1, there is shown a schematic of a laboratory electrolytic cell 10 used for electrolytically reducing alumina to aluminum, in accordance with the invention. Cell 10 can be comprised of an alumina or metal crucible 12 containing anodes 14 of the invention and cathode 16. A molten salt electrolyte 18 also is provided in cell 10. Cell 10 is sealed with a cover 2. Anodes 14 and cathode 16 are suspended through lid 2 from a superstructure (not shown) and connected to bus bars above the cell. Anodes 14 and cathode 16 are in the form of vertical plates with an anode on each side of the cathode. The cathode used in the test cell was titanium and the anodes were comprised of carbon. The molten salt electrolyte was comprised of 38.89 wt. % sodium fluoride and 61.11 wt. % aluminum fluoride. For tests, typically the molten electrolyte was maintained below 900° C. and typically in the range of 730° to 800° C. although the temperature can range from 660° to 800° C. for low temperature operation. When the cell is operated, aluminum is deposited at the cathode and collects in a pool 20. If the crucible 12 is comprised of metal, an insulated reservoir is required to collect molten aluminum 20. If crucible 12 is comprised of refractory, molten aluminum can collect on the bottom of the cell, as shown in FIG. 1, and removed by siphon or ladle.

Typically, the cell can employ electrolytes 18 comprised of $NaF+AlF_3$ eutectics, $KF+AlF_3$ eutectic, and LiF. The electrolyte can contain 6 to 40 wt. % NaF, 7 to 33 wt. % KF, 1 to 6 wt. % LiF and 60 to 65 wt. % $AlF_3$. More broadly, the cell can use electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can comprise 62 to 53 mol. % NaF and 38 to 47 mol. % $AlF_3$.

The present invention has the advantage that it efficiently electrolyzes alumina in a molten electrolyte in a low temperature electrolytic cell at substantial savings in electricity costs. That is, cell decomposition voltage for alumina in a low temperature cell of the invention is less than 2 volts and suitably in the range of 1.63 to 1.73 volts with the preferred decomposition voltage being about 1.7 volts. This may be compared to the same or similar cells employing inert anodes wherein the cell decomposition voltage for alumina is in the range of about 2.3 to 2.6 volts, depending on the current density and the inert anodes used. Thus, it will be seen that the use of a planar carbon anode results in considerable cost savings. Further, current efficiency can be very high and can be in the range of 90 to 95%. Further, the planar carbon anodes have a carbon factor of 0.36 to 0.38 pounds per pound of metal produced.

In the cell shown in FIG. 1, alumina particles 26 are provided in hopper 24 and can be added to cell 10 on a continuous basis. The alumina particles are deposited on surface 22 and ingested into the molten salt electrolyte.

Carbon as used herein is meant to include all types of carbon used for anodes, including graphitized carbon.

In the present invention, the cell can be operated at a current density in the range of 0.1 to 1.5 $A/cm^2$ while the electrolyte is maintained at a temperature in the range of 660° to 800° C. A preferred current density is in the range of about 0.4 to 1.3 $A/cm^2$. The lower melting point of the bath (compared to the Hall cell bath which is above 950° C.) permits the use of lower cell temperatures, e.g., 730° to 800° C.

The anodes and cathodes in the cell can be spaced to provide an anode-cathode distance in the range of ¼ to 1 inch. That is, the anode-cathode distance is the distance between anode surface 8 and cathode surface 28 or 30.

Further, in a commercial cell thermal insulation can be provided around liner or crucible and on the lid in an amount sufficient to ensure that the cell can be operated without a frozen electrolyte crust and accumulation of frozen electrolyte on the side walls. The absence of frozen electrolyte crust is important because it permits alumina to be added continuously without need for periodic breaking of the frozen crust.

Figure 2:
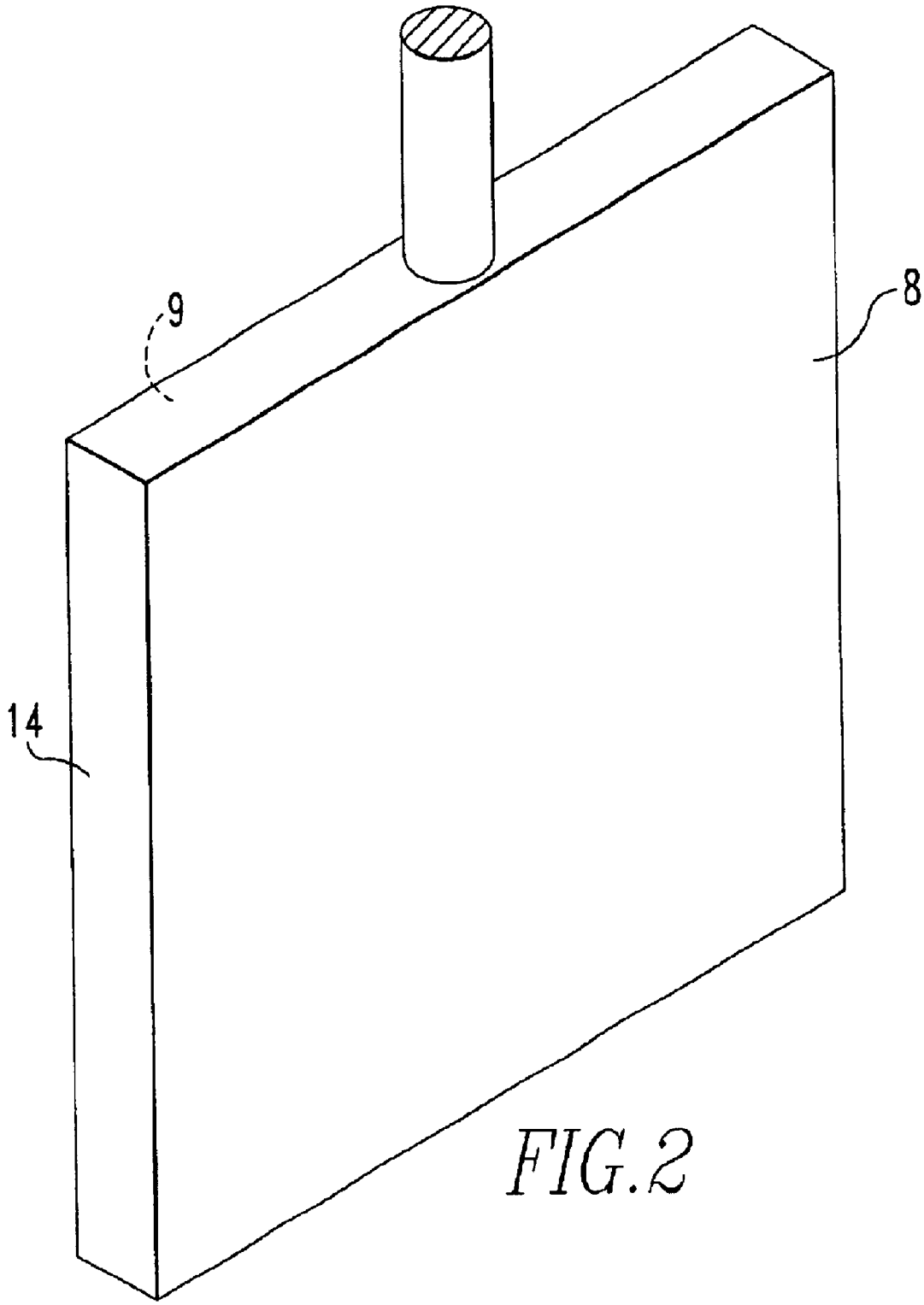
FIG. 2 is a dimensional view of a planar carbon anode of the invention.

FIG. 2 is a dimensional view of carbon anode 14 in accordance with the invention having a surface 8 and an opposed surface 9. For purposes of the invention, anode 14 can have a thickness of 4 to 8 inches for commercial applications. It will be appreciated that as carbon in the anode reacts with oxygen or oxygen-bearing compounds to form carbon monoxide or carbon dioxide, the carbon in the anode gets used and thus the anode must be replaced periodically. The replacement of the anode should take into consideration the anode-cathode distance which, if it becomes too great, can interfere with economics of the cell. To control the anode-cathode distance as the anode surface wears, double anodes may be employed. Each anode may be moved away from each other towards the opposing cathode to maintain the desired anode-cathode distance for a longer period of time, depending on carbon factor and current density. Alternatively, to maintain the desired anode-cathode distance, double cathodes may be used and the cathode moved towards the opposing anode as the anode surface wears, depending on carbon factor and current density.

In another embodiment of the invention, the anodes can be employed to efficiently provide alumina-enriched electrolyte to active surface of anodes 14. That is, molten salt electrolyte has certain flow patterns within cell 10 (FIG. 3) and alumina particles 26 are added to surface 22 of the electrolyte from hopper 24. In the embodiment illustrated in FIG. 3, molten electrolyte is shown flowing in a downward direction adjacent walls 4 and 6 of cell 10 and in an upwardly direction adjacent cathode surfaces 28 and 30. The lift or upward direction movement of the molten electrolyte is caused in part by the evolution of gases such as carbon-containing gas, e.g., $CO_2$, at the active anode surface.

In the present invention, apertures 32 are provided in anodes 14 to permit flow of alumina-enriched electrolyte to be quickly available at active surfaces 8 of anodes 14. Thus, during operation of cell 10, molten electrolyte flows downwardly adjacent walls 4 and 6 and simultaneously therewith flows through holes or apertures 32 supplying alumina laden or enriched electrolyte to anode active surfaces 8. This has the advantage of minimizing starvation of alumina at the active surface of the anode. Thus, it will be appreciated that gradations of concentrations of alumina can occur with conventional planar anodes and in commercial cells the distance along the surface of the anode can be vary significant, adversely affecting operation of the cell. That is, at the center, for example, of the anode surface there can be starvation of available alumina.

The apertures provided in anodes 14 have another benefit. That is, depending on the number of apertures and the thickness of the anode, the apertures can contribute to the active surface area of the anode. Thus, in the present invention, ratio of anode active surface to cathode active surface can range from 1:1 to 1:5. Apertures 32 have a cylindrical shape. However, other shapes such as square or oval, for example, are contemplated. Further, apertures 32 can have a fluted or funnel shape. That is, aperture 32 can increase in diameter from one side of the anode to the other, e.g., from the non-active surface to the active surface. The active surface of the anode is the surface opposite the cathode surface and can include the wall defining apertures 32.

Figure 4:
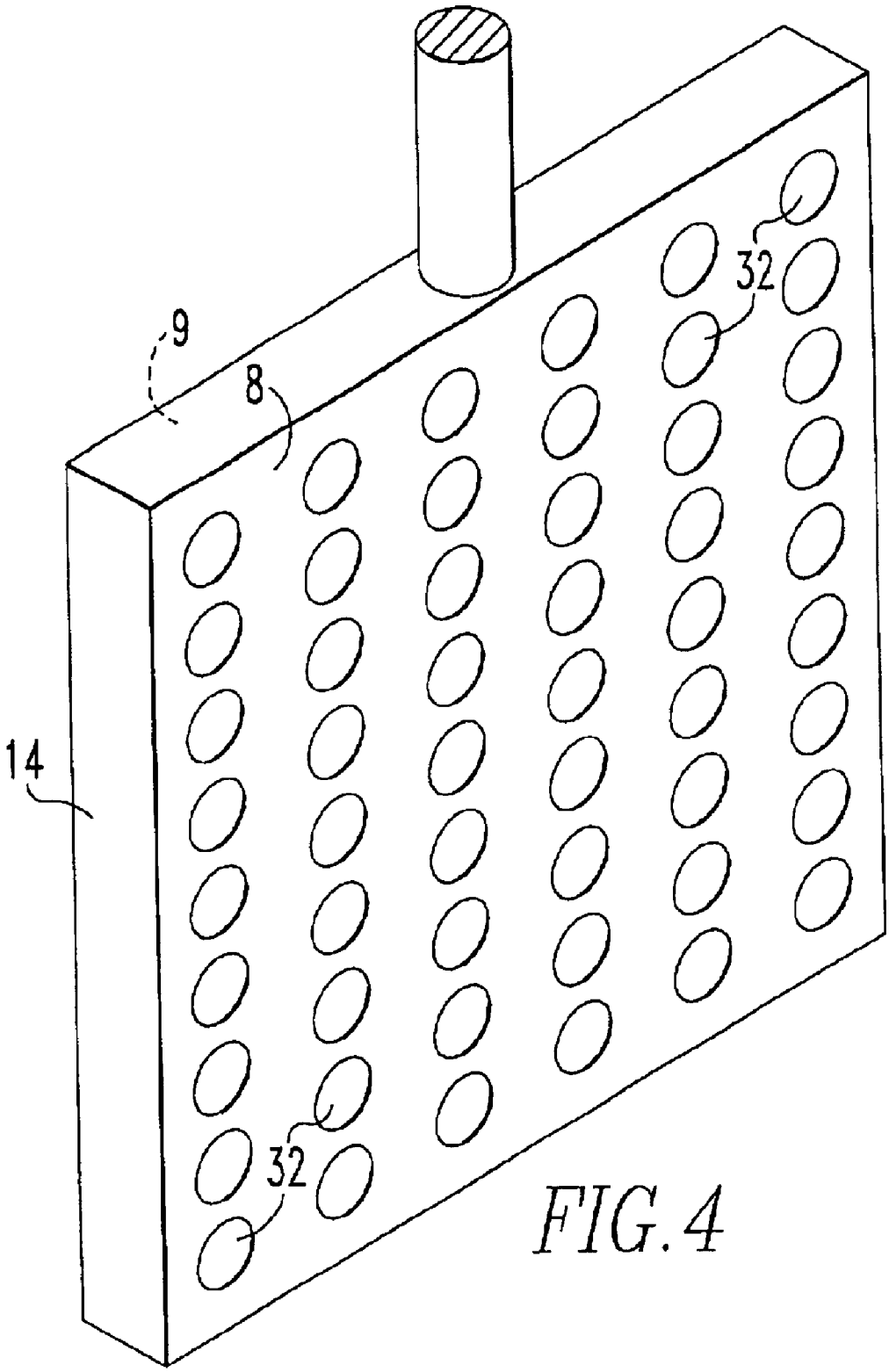
FIG. 4 is a dimensional view of a planar carbon anode having apertures therein in accordance with the invention.

FIG. 4 is a dimensional view of anode 14 illustrating apertures 32 provided across the thickness of anode 14 from surface 8 to surface 9. The apertures can be formed by any convenient manner such as by drilling. Further, the apertures can have a diameter from about ⅛ inch to about 1 inch, depending on the commercial cell and the size of the anode being used.

Alumina useful in the cell can be any alumina that is comprised of finely divided particles. Usually, the alumina has a particle size in the range of about 1 to 100 μm.

Figure 5:
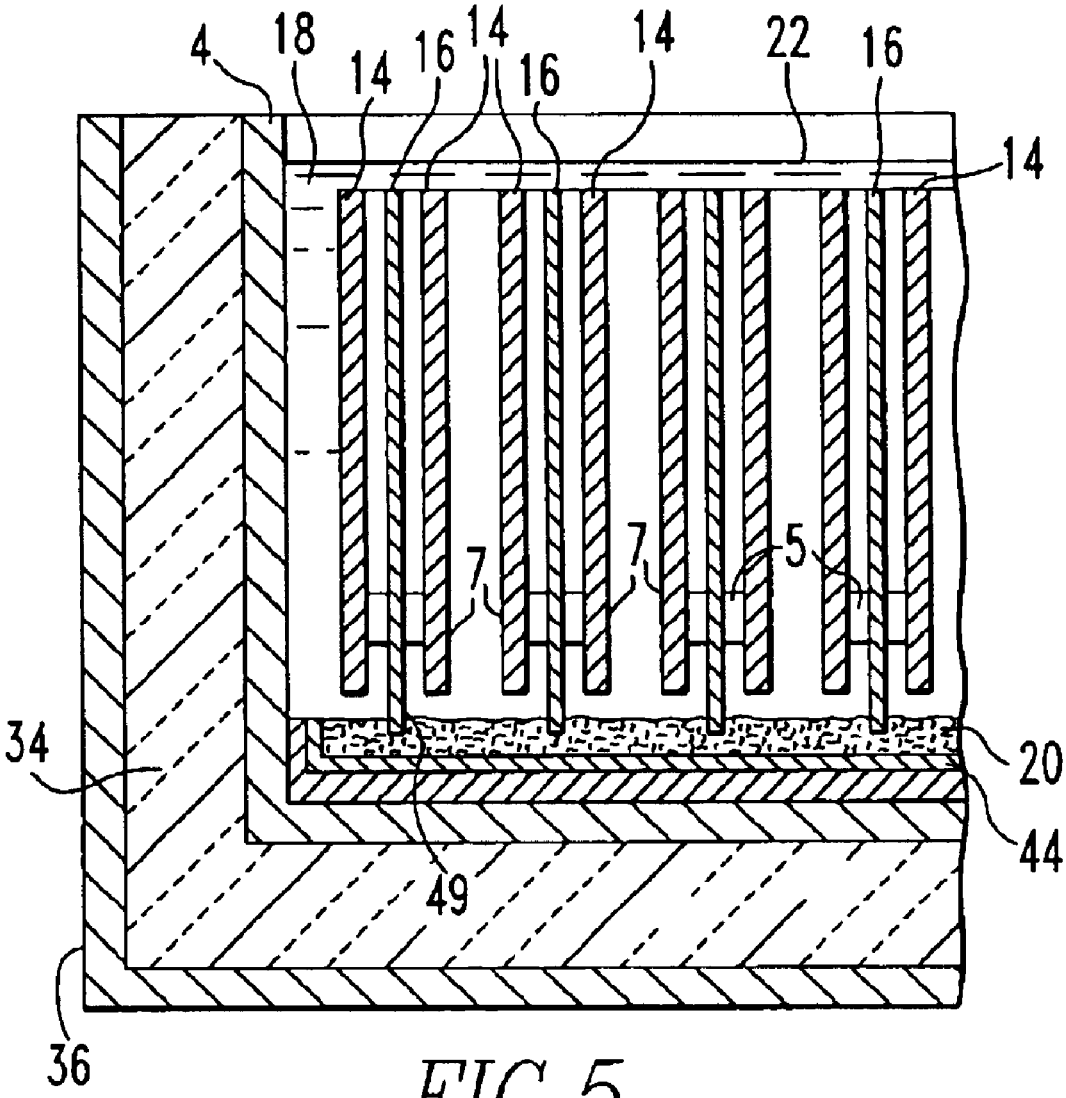
FIG. 5 is an illustration of a partial cross-sectional view of an electrolytic cell showing anode and cathodes in interleaving relationship.

FIG. 5 is a cross-sectional view of a portion of a commercial type cell showing planar anodes 14 and cathodes 16. In the embodiment shown in FIG. 5, electrolyte 18 is shown contained by a liner 4. For simplification purposes, no lid or superstructure for holding or supporting electrodes is shown. Thus, it will be seen that anodes 14 and cathodes 16 are provided in groups of three (anode 14-cathode 16-anode 14) where anodes 14 are provided adjacent each other. In the embodiment illustrated in FIG. 5, cathodes 16 are shown having protrusions 49 which extend into molten aluminum 20. However, this is not essential. Anodes 14 have a lower edge 7 located above molten aluminum 20. The anodes and cathodes can be separated by non-conductive spacers 5 if necessary. If liner 4 is metal, molten aluminum 20 can be collected in an electrical insulated trough or channel 44 from where it siphoned or tapped from the cell. In FIG. 5, a layer of insulation 34 is shown contained by shell 36. This permits the cell to operate without a side ledge or crust, if desired.

The following example is still further illustrative of the invention.

EXAMPLE

Figure 3:
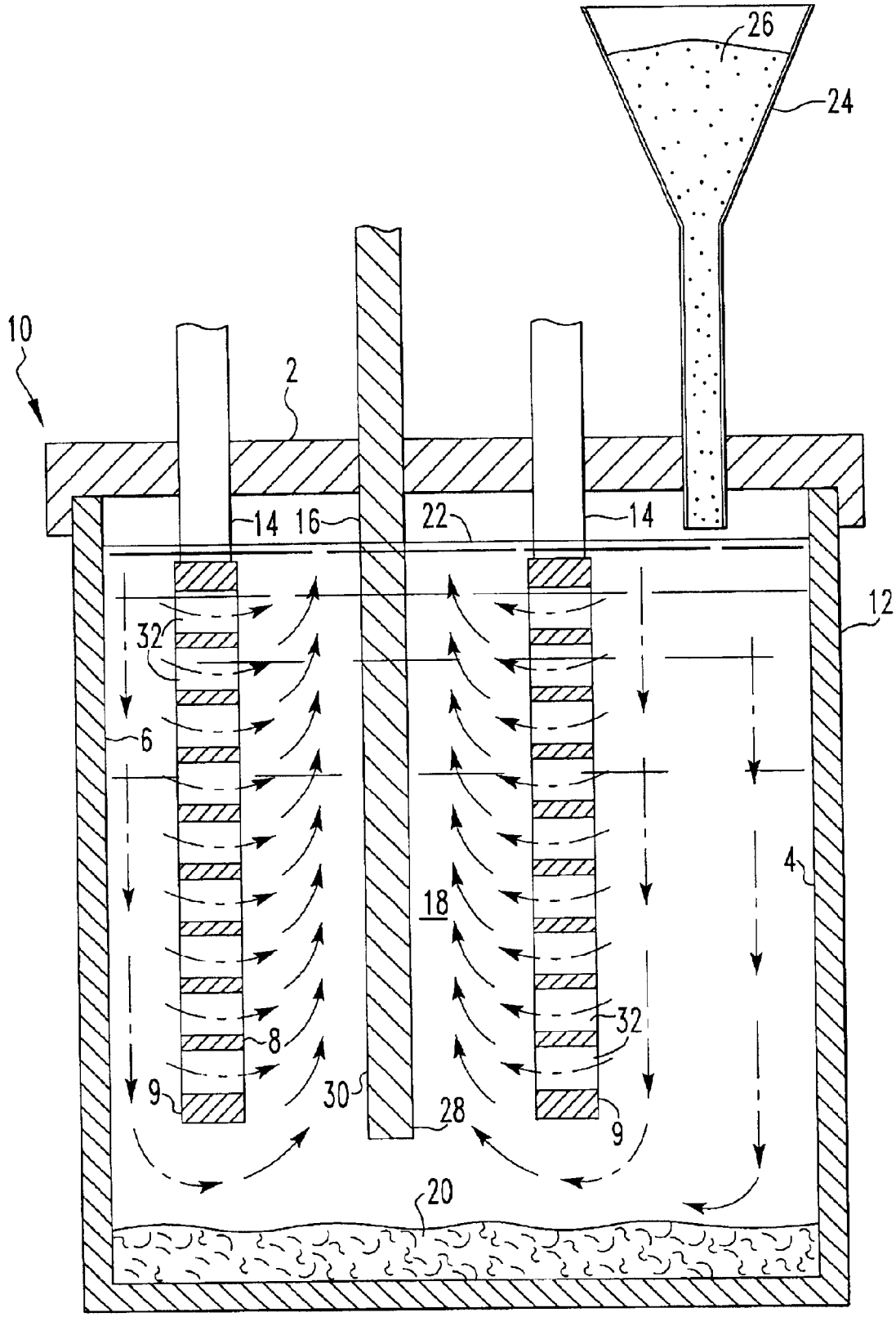
FIG. 3 is a cross-sectional view of an electrolytic cell used in testing an anode having apertures in accordance with the invention.

This invention was tested in a 200 A cell having the configuration shown in FIG. 3 with alumina added to the cell substantially continuously. The cell comprised an alumina ceramic container. Within the ceramic container was placed a vertical cathode suspended through the lid of the container and connected to a bus bar. On either side of the cathode, two carbon anodes were positioned or suspended through the lid and connected to bus bar. The anodes were 3.5 inches by 3.5 inches by 0.50 inch thick. Each anode was drilled to provide 16 holes ⅜ inch in diameter. The anodes were comprised of graphitized carbon and the cathode was comprised of titanium. The cell contained a molten salt bath comprised of 38.89 wt. % sodium fluoride and 61.11 wt. % aluminum fluoride. The top of the cell was sealed with an insulating lid and the cell was maintained at an operating temperature of 770°–780° C. which was above the melting point of the salt bath and the aluminum metal. The alumina fed to the cell had a particle size up to 100 μm and was effectively ingested by the circulation of the bath in the cell during operation. The cell was operated at a current density of 1 amp/cm$^2$ for a period of about 8.5 hours. Aluminum deposited at the cathode drained downwardly to the bottom of the cell and was removed periodically. Carbon dioxide gas evolved at the active face of the anode and provided a generally upward movement of the bath in the regions between the anode and the cathode. The bath had a generally downward movement between anode and the wall of the container. Carbon dioxide gas was removed from the cell through feed tube of the alumina. The apertures provided in the anodes permitted alumina-rich electrolyte to more effectively reach the active regions of the electrodes without the need to travel to the bottom of the anode and then to the surface of the electrolyte to get replenished. The anodes were used for about 8.5 hours. The carbon anodes resulted in a current efficiency of 94% and a carbon factor of 0.36 to 0.38 pounds per pound of aluminum metal produced.

Having described the presently preferred embodiments, it is to be understood that the invention may be otherwise embodied within the scope of the appended claims.

What is claimed is:

1. A method of producing aluminum in an electrolytic cell containing alumina dissolved in an electrolyte, the method comprising the steps of:

(a) providing a molten salt electrolyte consisting essentially of fluoride salts at a temperature of less than 900° C. having alumina dissolved therein in an electrolytic cell, said electrolyte having a surface, said cell having a liner for containing said electrolyte, said liner having a bottom and walls extending upwardly from said bottom;

(b) providing a plurality of anode plates and cathode plates having planar surfaces disposed in a vertical orientation in said electrolyte, said anode plates and cathode plates arranged in alternating relationship to provide anode planar surfaces disposed opposite cathode planar surfaces to define a region therebetween, the cathode plates comprised of material substantially inert to molten aluminum the anode plates comprised of carbon; and (c) passing electrical current through said anode plates and through said electrolyte to said cathode plates, depositing aluminum at said cathode plates and forming a carbon-containing gas at said anode plates, said cell having a decomposition voltage for alumina in the range of 1.63 to 1.73 volts.

2. The method in accordance with claim 1 including maintaining said electrolyte in a temperature range of about 660° to 800° C.

3. The method in accordance with claim 1 wherein said electrolyte has a melting point in the range of 715° to 800° C.

4. The method in accordance with claim 1 including passing an electric current through said cell at a current density in the range of 0.1 to 1.5 A/cm$^2$.

5. The method in accordance with claim 1 wherein said cathode plates are selected from the group consisting of titanium diboride, zirconium diboride, titanium carbide, zirconium carbide, molybdenum, and titanium and tungsten alloys.

6. The method in accordance with claim 1 including adding alumina to said cell on a substantially continuous basis.

7. The method in accordance with claim 1 wherein said electrolyte is comprised of one or more alkali metal fluorides.

8. The method in accordance with claim 1 wherein said electrolyte is comprised of one or more alkali metal fluorides and aluminum fluoride.

9. The method in accordance with claim 1 including maintaining alumina in said electrolyte in a range of 3.5 to 5.0 wt. %.

10. The method in accordance with claim 1 including operating said cell without a frozen crust.

11. The method in accordance with claim 1 including thermally insulating said cell sufficiently to avoid formation of frozen electrolyte on cell walls or formation of frozen electrolyte on said surface.

12. A method of producing aluminum in an electrolytic cell containing alumina dissolved in an electrolyte, the method comprising the steps of:

(a) providing a molten salt electrolyte at a temperature in the range of 660° to 800° C. having alumina dissolved therein in an electrolytic cell, said electrolyte having a surface, said cell having a liner for containing said electrolyte, said liner having a bottom and walls extending upwardly from said bottom, said cell having a decomposition value for alumina of less than 2 volts;

(b) providing a plurality of anode plates and cathode plates having planar surfaces disposed in a vertical orientation in said electrolyte, said anodes and cathodes arranged in alternating relationship to provide anode planar surfaces disposed opposite cathode planar surfaces to define a region therebetween, the anodes comprised of carbon and having apertures through said anode planar surfaces to promote flow of alumina-enriched electrolyte to said region between said anode and cathode planar surfaces; and (c) passing electrical current through said anodes and through said electrolyte to said cathodes, depositing aluminum at said cathodes and forming a carbon-containing gas at said anodes at a current density in the range of 0.1 to 1.5 A/cm$^2$, said cell having a decomposition voltage for alumina in the range of 1.63 to 1.73 volts.

13. The method in accordance with claim 12 wherein said electrolyte has a melting point in the range of 715° to 800° C.

14. The method in accordance with claim 12 wherein said cathodes are selected from the group consisting of titanium diboride, zirconium diboride, titanium carbide, zirconium carbide, molybdenum, and titanium and tungsten alloys.

15. The method in accordance with claim 12 including adding alumina to said cell on a substantially continuous basis.

16. The method in accordance with claim 12 wherein said electrolyte is comprised of one or more alkali metal fluorides.

17. The method in accordance with claim 12 wherein said electrolyte is comprised of one or more alkali metal fluorides and aluminum fluoride.

18. The method in accordance with claim 12 including operating said cell without a frozen crust.

19. The method in accordance with claim 12 including thermally insulating said cell sufficiently to avoid formation of frozen electrolyte on cell walls or formation of frozen electrolyte on said surface.

20. In a method of producing aluminum in an electrolytic cell containing alumina dissolved in a fluoride salt electrolyte wherein the cell is free of a frozen electrolyte crust, the electrolyte having alumina dissolved therein, and alumina add to the electrolyte on a continuous basis to provide alumina-enriched electrolyte, and wherein a plurality of anode plates and cathode plates are disposed in a vertical direction and in alternating relationship in said electrolyte, said cathodes having a flat surface, the method comprising:

(a) providing carbon anodes having a planar surface disposed opposite the flat surface of the cathode to define a region between the cathode flat surface and the planar surface of the anode, said anodes having apertures through said anode planar surfaces to promote flow of alumina-enriched electrolyte to said region between said anode and cathode planar surfaces and;

(b) passing electrical current through said anodes and through said electrolyte to said cathodes, depositing aluminum at said cathodes and producing carbon-containing gas at said anodes, said cell having a decomposition voltage for alumina in the range of 1.63 to 1.73 volts.

21. The method in accordance with claim 20 wherein said electrolyte is comprised of one or more alkali metal fluorides.

22. The method in accordance with claim 20 wherein said electrolyte is comprised of one or more alkali metal fluorides and aluminum fluoride.

23. The method in accordance with claim 20 including maintaining said electrolyte in a temperature range of about 660° to 800° C.

24. The method in accordance with claim 20 wherein said electrolyte has a melting point in the range of 715° to 800° C.

25. The method in accordance with claim 20 including passing an electric current through said cell at a current density in the range of 0.1 to 1.5 A/cm$^2$.

26. The method in accordance with claim 20 wherein said cathodes are comprised of a material selected from the group consisting of titanium diboride, zirconium diboride, titanium carbide, zirconium carbide, molybdenum, and titanium and tungsten alloys.

* * * * *